United States Patent [19]

Walker

[11] 3,971,080

[45] July 27, 1976

[54] RECESSED BATHTUB

[76] Inventor: Irene D. Walker, 206 Sostes Drive, Cleveland, Miss. 38732

[22] Filed: Nov. 10, 1972

[21] Appl. No.: 305,489

[52] U.S. Cl. ..... 4/173 R
[51] Int. Cl.[2] ..... A47K 3/00; A47K 3/04
[58] Field of Search ..... 4/173, 173.5, 152, 145, 4/175, 146

[56] References Cited

UNITED STATES PATENTS

| | | | |
|---|---|---|---|
| 1,426,519 | 8/1922 | Swift | 4/152 |
| 1,997,249 | 4/1935 | Dobbs | 4/173 |
| 2,204,929 | 6/1940 | Fairhurst | 4/146 |
| 2,255,893 | 9/1941 | Mullet | 4/145 |
| 2,306,934 | 12/1942 | Cade | 4/173 |
| 2,859,453 | 11/1958 | Bloch | 4/199 |
| 3,293,666 | 12/1966 | Casalini | 4/175 |
| 3,496,579 | 2/1970 | Petersen | 4/173 |
| 3,562,821 | 2/1971 | Queen | 4/146 |
| 3,587,118 | 6/1971 | Compton | 4/146 |
| 3,604,018 | 9/1971 | Moran | 4/173 |
| 3,616,467 | 11/1971 | Drain | 4/146 |

FOREIGN PATENTS OR APPLICATIONS

| | | | |
|---|---|---|---|
| 455,283 | 2/1950 | Italy | 4/146 |
| 498,156 | 1/1939 | United Kingdom | 4/146 |

*Primary Examiner*—Stanley N. Gilreath
*Assistant Examiner*—Donald B. Massenberg
*Attorney, Agent, or Firm*—John R. Walker, III

[57] ABSTRACT

A bathtub which has specific advantages for certain physically handicapped or infirm persons. The bathtub includes a circular well which is recessed below the floor level. A crescent-shaped bench is included which supports the user in a comfortable sitting position and provides a step, also below the floor level, to accommodate the ingress and egress of the user. A pair of remotely disposed showerheads are included which may selectively be turned on or off in unison and/or individually. A hand railing having a gate portion is disposed a distance above the floor and extends circumferentially around the well to provide a safety barrier and to assist the user into and out of the bathtub.

1 Claim, 2 Drawing Figures

RECESSED BATHTUB

BACKGROUND OF THE INVENTION

1. Field of the Invention

This invention pertains to the field of bathtubs.

2. Description of the Prior Art

A preliminary patentability search revealed the following U.S. patents: Mullet U.S. Pat. No. 2,255,893; Boone U.S. Pat. No. 2,714,725; Casalini U.S. Pat. No. 3,293,666; Drain U.S. Pat. No. 3,616,467; Queen U.S. Pat. No. 3,562,821; Compton U.S. Pat. No. 3,587,118; and Moran U.S. Pat. No. 3,604,018. None of the above patents show or suggest applicant's bathtub. As a matter of fact, most of the above patents pertain to compartment showers or cabinets for bathing. Additionally, even though most of the above patents include a seat to accommodate the user in a comfortable sitting position, only U.S. Pat. Nos. 2,714,725 and 3,604,018 disclose structure which enables the user to be partially submerged while sitting on the seat. However, the well of U.S. Pat. No. 2,714,725 has an opening which the user may pass through and which is closed by a door which is watertight when in the closed position, i.e., the well may only be filled to the desired level subsequent to the user's getting into the cabinet. U.S. Pat. No. 3,604,018 includes a revolving drum which has an opening leading into a seat. The invalid may sit on the seat within the drum part, and the drum may be rotated until the open segment faces the open side of the fixed part of the bathtub. The seat may then be lowered to the bottom of the tub or to any desired intermediate level. Certain disadvantages are inherent in U.S. Pat. Nos. 2,714,725 and 3,604,018: First, in both U.S. Pat. Nos. 2,714,725 and 3,604,018, the possibility of water leaking past the closure is ever present and/or inevitable after prolonged usage. Second, the structure of U.S. Pat. No. 3,604,018 is rather complex and the probability of a malfunction is extremely high. Third, the cost of the bathtub disclosed by the U.S. Pat. No. 3,604,018 probably would be high and would adversely affect the demand for a bathtub of this type. Fourth, certain structure of U.S. Pat. No. 3,604,018 is electrically operated which presents to the user the hazard of getting shocked.

SUMMARY OF THE INVENTION

The present invention is directed towards overcoming the disadvantages and problems relative to previous bathtubs. The concept of the present invention is to provide a bathtub which has specific advantages for certain physically handicapped or infirm persons. More specifically, the bathtub of the present invention facilitates the task of bathing and/or showering oneself selectively even though the user may be physically handicapped. The bathtub of the present invention includes a circular well which is recessed below the floor level. A cresent-shaped bench is included which supports the user in a comfortable sitting position and provides a step, also below the floor level, to accommodate ingress and egress of the user. The well and bench preferably are integrally formed from any well-known substance, e.g., cast iron, fiberglass or like.

The bathtub of the present invention offers several advantages over the prior art:

First, the middle part of the body of the user may be submerged. This is a particularly important feature since many of the infirm prefer the relaxation associated with soaking in hot water. Equally important is the fact that the bath may be drawn prior to the user's slipping into the water. Second, the likelihood of leaks is substantially non-existent. Third, since there are no moving parts, the likelihood of a malfunction is non-existent. Fourth, the simplicity of construction is an important feature of the present invention. The bathtub is inexpensive to manufacture, and considering the other advantages offered, it should be in great demand. Fifth, the likelihood of the user's getting an electrical shock is non-existent.

A pair of remotely disposed showerheads are included which may selectively be turned on or off in unison and/or individually. A hand rail having a gate portion is disposed a distance above the floor and extends circumferentially about the well to provide a safety barrier and to assist the user into and out of the bathtub. The perimeter of the well may extend a predetermined distance above the floor level establishing a ridge which would not be too high for a handicapped person to step over, particularly since he has a rail to hold on to. This latter feature makes provisions for the well to be of an optimum depth without the user's having to step too far below the floor level. In other words, the user, while holding onto the hand rail, simply lifts one leg over the ridge and uses the bench as a step to simply step on down into the bottom of the bathtub. The bench and the bottom of the bathtub preferably have a surface which prevents the user from slipping.

The advantages of the two showers are: First, filling the bathtub is less time-consuming, thus less tiring to the user. Second, in the even the user is just taking a shower, he can control both showers simultaneously with the integrated control which provides instant temperature choice. This means that the user can very quickly wet himself with tepid water, turn the water off, soap himself, and turn the water on. He may repeat this procedure as often as desired and thoroughly rinse himself without the necessity of turning around to expose his entire body to a single shower or adjust hot and cold water to an optimum mixture. It should be pointed out that many infirm persons are incapable of turning around while standing under conventional showers.

DESCRIPTION OF THE PREFERRED EMBODIMENT

The bathtub 11 of the present invention is intended to be recessed below a floor 13. The bathtub 11 has specific advantages for certain physically handicapped or infirm persons, e.g., certain elderly people lacking stability and strength find it almost impossible to utilize the conventional bathtub found in most homes today, at least without assistance. In other words, the simple task of climbing over the high wall of the bathtub, assuming a sitting position on the flat floor thereof, and subsequently assuming the standing position within the bathtub are tasks too difficult for many people who are otherwise able to take care of themselves.

Figure 1:
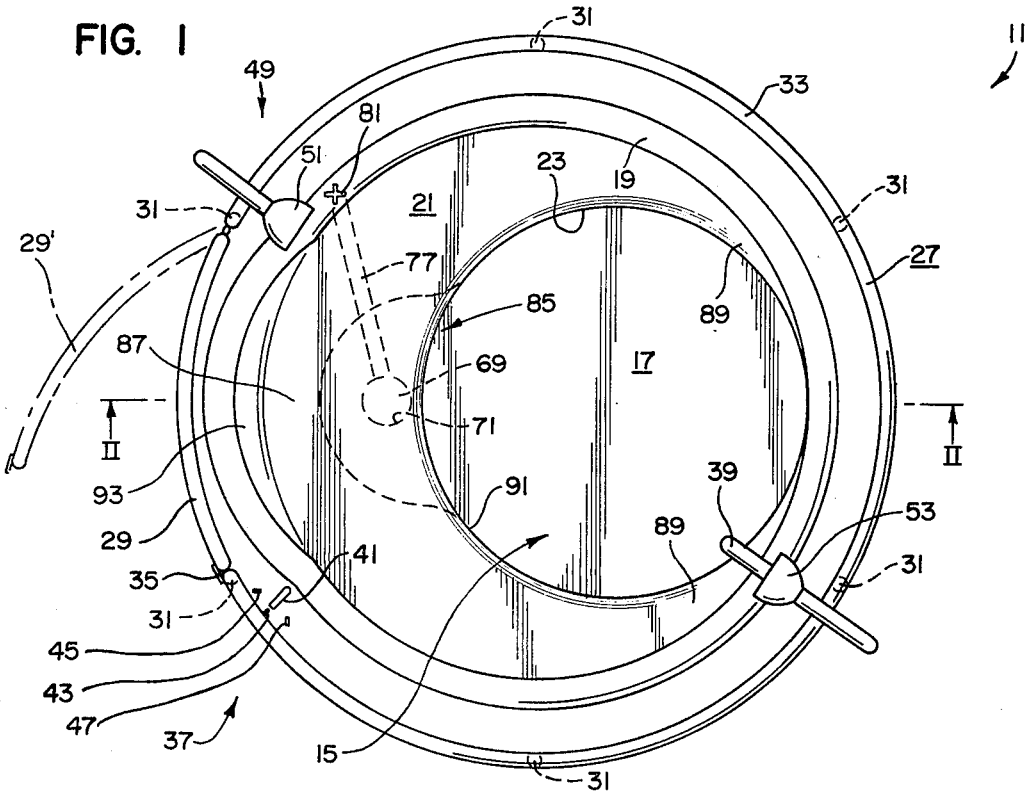
FIG. 1 is a plan view of the recessed bathtub of the present invention with the gate being phantomized in the open position.

The bathtub 11 includes a well 15 having a circular shaped bottom 17 and a first continuous circular wall 19 encompassing the bottom 17 and being tangentially disposed thereto as clearly shown in FIG. 1 of the drawings. A cresent-shaped bench 21 is included for supporting the user in a sitting position and for providing a step to accommodate ingress and egress of the user. The bathtub 11 also includes a second continuous circular wall 23 tangentially engaging the first circular wall 19 and joining the bottom 17 to the bench 21 so as to reduce the volume of the well 15 in the area below the bench 21. In other words, the object being to require as little water as possible to raise the level of the water in the well 15 sufficiently to submerge the middle part of the body of the user. From FIG. 1 of the drawings, it may be seen that the diameter of the first circular wall 19 is greater than the diameter of the second circular wall 23 and the difference in diameters thereof defines the cresent-shaped bench 21.

It will be understood that shapes other than a true circle may be used for the shape of bottom 17, wall 19 and wall 23, as for example, an oblong shape, without departing from the spirit and scope of the present invention.

Figure 2:
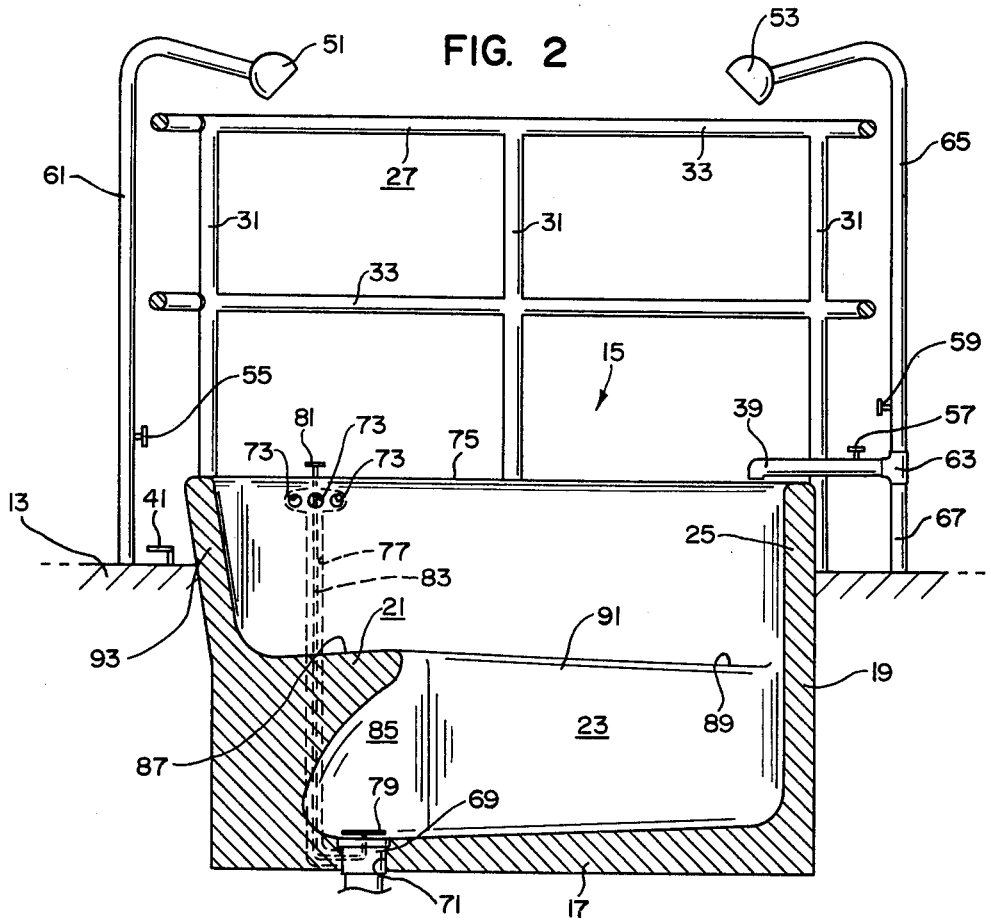
FIG. 2 is a sectional view taken as on the line II—II of FIG. 1.

From FIG. 2 of the drawings, it may be seen that the first circular wall 19 extends a predetermined distance upwardly from the floor 13 establishing a ridge 25. Additionally, the bottom 17 and the bench 21 are recessed below the floor 13.

The bathtub 11 also includes hand rail means 27 for assisting the user into and out of the well and for providing a safety barrier thereabout, i.e., obviating the likelihood of someone accidentially falling into the well 15, particularly in the dark. From FIG. 1 of the drawings, it may be seen that the hand rail means 27 is disposed circumferentially about the well 15 and from FIG. 2 of the drawings, it may be seen that the hand rail 27 is supported a predetermined distance above the floor 13.

The hand rail means 27 includes a gate 29 which is phantomized in an open position in FIG. 1 and character referenced in the open position by the numeral 29'. The hand rail means 27 and the gate 29 may be of any well known construction obvious to those skilled in the art. Therefore, it should be sufficient to simply state that the hand rail means 27 includes a plurality of vertical members 31 having the respective lower ends thereof fixedly attached to the floor 13 in a manner obvious to those skilled in the art. The hand rail means 37 also includes a pair of circular horizontal members 33 which are fixedly attached to the vertical members 31 in a manner obvious to those skilled in the art. The gate 29 preferably includes well-known hinge structure (not shown) for urging the gate towards the closed position which is shown in solid lines in FIG. 1 of the drawings. Additionally, suitable latch means 35 are included for holding the gate 29 in the closed position.

The bathtub 11 includes means 37 for controllably filling the well 15 full of water. The water filling means 37 includes a filling spout 39 suitably communicated with water control means 41. The water filling means 37 preferably is of the well known type which eliminates the necessity for adjusting the hot and cold water streams to the right temperature by giving instant temperatures of only two choices. In other words, the control means 41 preferably has three positons: an off position 43, a tepid position 45 and a hotter position 47, all of which is well known to those skilled in the art.

The bathtub 11 also includes shower head means 49 supported a predetermined distance above the bottom 17 and being communicated with the water filling means 37. More specifically, the shower head means 49 preferably includes at least a pair of remotely disposed individual spray or gusher elements 51, 53 integrated with the water filling means 37. Valve means 55, 57, 59 are included for selectively interrupting the flow of water from the shower head means 49 or the gusher elements 51, 53 and the filler spout 39.

More specifically, the gusher element 51 is communicated with the water control means 41 by a conduit 61 having the valve 55 interposed therein as shown in FIG. 2 of the drawings. Additionally, the gusher element 53 is communicated with a T-fitting 63 by a conduit 65 having the valve 59 interposed therein. Further, the filler spout 39 is communicated with the T-fitting 63 having the valve 57 interposed therebetween. Further yet, the T-fitting 63 is communicated with the water control means 41 by a conduit 67.

Therefore, placing the valves 55, 57, 59 in the open position and moving the control 41 from the off position to the tepid position 45 causes water to flow from the filling spout 39 and the gusher elements 51, 53, i.e., filling the well 15 in the least possible time. Moving the control 41 to the off position 43 stops the flow of water completely.

On the other hand, closing the valves 55, 59 and leaving the valve 57 open allows water to flow from the filling spout 39 only. Further, closing the valve 57 and opening valves 55, 59 allows water to spray outwardly from both the gusher elements 51, 53 simultaneously. However, in the event the user desires to use only one gusher element such as the gusher element 53, the valve 59 will be open and the valves 55, 57 will be closed. It should be understood that the above disclosure of valves 55, 57, 59, T-fitting 63, and conduits 61, 65, 67 are to be construed as illustrative only or one means of accomplishing the desired function. In other words, suitable structure obvious to those skilled in the art which accomplishes the same function as disclosed may be substituted and suitably interconnected without departing from the spirit and scope of the present invention.

Also included is a drain 69 for controllably disposing of the water in the usual manner. The bottom 17 is provided with an aperture 71 for receiving the drain 69 and the bottom 17 preferably slopes downwardly toward the drain 69 as clearly shown in FIG. 2 of the drawing.

The bathtub 11 includes overflow means or at least one mouthlike opening 73 disposed adjacent upper edge 75 of the circular wall 19 for receiving the water which rises to that level. Also included is conduit means 77 for communicating the mouthlike opening 73 with the drain 69 whereby the well 15 is prevented from overflowing. It should be understood that the conduit means 77 may be external of the wall 19 or integrally formed and embedded in the wall 19 in a manner obvious to those skilled in the art.

Plug structure 79 is included for blocking the drain 69. The plug 79 is depicted in FIG. 2 in an unblocked position and may be moved downwardly to a blocked position wherein the plug 79 closes off the drain 69. A handle 81 preferably is included for remotely moving the plug 79 between the blocked and unblocked positions. Accordingly, linkage means 83 of known construction is included for mechanically connecting the handle 81 to the plug 79 with the linkage means 83 preferably being received in the conduit means 77 as shown in FIG. 2 of the drawing.

The second continuous wall 23 preferably is provided with a nichelike concavity 85 for accommodating the lower legs and feet of the user while he is in a sitting position on the bench 21. The concavity 85 is disposed below the bench 21 and preferably is substantially intermediate the length thereof, as clearly shown in the drawings.

From FIG. 1 of the drawings, it may be seen that the cresent-shaped bench 21 has a broad intermediate portion 87 disposed above the concavity 85, opposing narrow portions 89, and a circular front edge portion 91, as clearly shown in the drawing. In this regard, the bench 21 preferably is slanted downwardly and rearwardly from the front edge 91 toward the first continuous wall 19. Additionally, at least a portion, as at 93, of the wall 19 is canted so as to be substantially perpendicular with the bench 21. In other words, portion 93 establishes a back for the bench to enhance the comfort of the user by comfortably supporting his back while he is in a sitting position on the bench 21. The canted portion 93 is shown terminating adjacent the broad intermediate portion 87 of the bench 21. However, it should be understood that the canted portion 93 may optionally extend further so as to be adjacent the narrow portions 89 without departing from the spirit and scope of the invention.

The narrow portions 89 of the bench 21 preferably are at a lower level than is the broad intermediate portion 87 to expedite water running off when disposing of the water from the well 15. However, water would naturally run from the broad portion 87 toward the narrow portions 89 even though the narrow portions 89 were at the same level as the broad portion 87 because of the gradual tapering away of the horizontal surface constituting the bench 21.

It should be pointed out that the bench 21 and the bottom 17 preferably are provided with surfaces which assure good footing so as to minimize the likelihood of the user's slipping thereon. Additionally, the well 15 is totally void of corners or small radii intersecting surfaces so as to prevent any sharp edges from irritating the user and to facilitate cleaning the corners of the well 15.

It should now be obvious that in using the bathtub 11, the user opens the gate 29 and while holding on to the hand rail 27, places one foot on the bench 21 and then the other foot so as to assume a standing position on the bench 21. He then steps on down to the bottom 17 while still being assisted by the hand rail 27. From this position, he can readily operate the valves 55, 57, 59 in a manner previously described and the water filling means 37. In other words, if the user desires to take a shower, he more than likely would not assume a sitting position on the bench 21 although some persons might prefer to do so. In showering, the user would wet himself by turning the control means 41 to the tepid position 45 so as to get wet, then he would turn the control 41 to the off position 43 while soaping and then turn the control 41 to the tepid position 45 to rinse. He would repeat this procedure as often as necessary to accomplish the complete showering process.

On the other hand, if the user desires to take a bath or submerge the middle part of his body in warm or hot water, he may draw the bath water prior to entering into the well 15. In this regard, the desired water level can be reached quicker by opening all the valves 55, 57, 59, thereby the infirm person finds it less tiring while waiting for the well 15 to fill with water. On the other hand, in the event the user desires a long soaking and the water temperature cools, he preferably would close the valves 55, 59 and turn the control 41 to the hotter position 47, allowing water to come from the filling spout 39 only to raise the temperature of the water in the well to the desired level. It should be pointed out that the ridge 25 should only be a few inches high so as not to obstruct the entrance of the user into the well 15. In fact, it may be desirable in certain instances to recess the well 15 further below the surface of the floor 13 than shown, i.e., certain physically handicapped users may desire that the ridge 25 be partially or completely eliminated which is within the intended scope of this invention.

Although the invention has been described and illustrated with respect to a preferred embodiment thereof, it is to be understood that it is not to be so limited since changes and modifications may be made therein which are within the full intended scope of the invention.

I claim:

1. The combination with a bathroom having a floor, of a bathtub for facilitating the task of bathing and showering oneself selectively even though the user may be physically handicapped, said bathtub comprising a well including a bottom and having a first continuous wall encompassing said bottom and being tangentially disposed thereto, cresecent shaped bench means for supporting the user in a sitting position and for providing a step to accommodate ingress and egress of the user, a second continuous wall tangentially engaging said first wall and joining said bottom to said bench means, the diameter of said first wall being greater than the diameter of said second wall with the difference in diameters thereof defining said crescent shaped bench means, said bottom and said bench means being recessed below said floor and said first wall extending a predetermined distance upwardly above the level of said floor for allowing said well to be of an optimum depth without requiring the user to step too far below the level of said floor, hand rail means for assisting the user into and out of said well and for providing a safety barrier thereabout, said hand rail means being disposed circumferentially about said well and supported a predetermined distance above said floor, means for controllably filling said well with water, shower head means supported a predetermined distance above said bottom and being communicated with said filling means, valve means for selectively interrupting the flow of water from said shower head means and said filler spout means, drain means for controllably disposing of the water, said bottom being provided with an aperture receiving said drain means and said bottom sloping downwardly towards said drain means, at least one mouthlike opening disposed adjacent the upper edge of said first wall for receiving the water which rises to that level, conduit means for communicating said mouthlike opening with said drain means whereby said well is prevented from overflowing, plug means for blocking said drain means, said plug means having blocked and unblocked positions thereto, handle means for remotely moving said plug means between said blocked and unblocked positions, and linkage means for mechanically connecting said handle means to said plug means with said linkage means being received in said conduit means and extending from a position below the level of said floor to a position above the level of said floor.

* * * * *